US008116060B2

(12) United States Patent
Orihara et al.

(10) Patent No.: US 8,116,060 B2
(45) Date of Patent: Feb. 14, 2012

(54) IONIZER

(75) Inventors: Masayuki Orihara, Tsukubamirai (JP); Takayuki Toshida, Tsukubamirai (JP); Akira Tadano, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 246 days.

(21) Appl. No.: 12/478,357

(22) Filed: Jun. 4, 2009

(65) Prior Publication Data

US 2010/0008010 A1 Jan. 14, 2010

(30) Foreign Application Priority Data

Jul. 8, 2008 (JP) ..... 2008-177611

(51) Int. Cl.
*H01T 23/00* (2006.01)

(52) U.S. Cl. ..... 361/231; 361/230; 250/423 R; 250/426; 315/111; 315/81

(58) Field of Classification Search ..... 361/230, 361/231, 229, 233; 315/111.81, 111.91; 250/423 R, 426
See application file for complete search history.

(56) References Cited

U.S. PATENT DOCUMENTS

| | | | | |
|---|---|---|---|---|
| 5,055,963 | A * | 10/1991 | Partridge | 361/231 |
| 5,593,476 | A * | 1/1997 | Coppom | 95/78 |
| 5,930,105 | A * | 7/1999 | Pitel et al. | 361/212 |
| 7,586,731 | B2 * | 9/2009 | Sato et al. | 361/231 |
| 2008/0197779 | A1 * | 8/2008 | Fisher et al. | 315/111.01 |

FOREIGN PATENT DOCUMENTS

| | | |
|---|---|---|
| JP | 2004-253192 | 9/2004 |
| JP | 2004-253193 | 9/2004 |

* cited by examiner

*Primary Examiner* — Patrick Salce
(74) *Attorney, Agent, or Firm* — Oblon, Spivak, McClelland, Maier & Neustadt, L.L.P.

(57) ABSTRACT

An ionizer includes a fan for blowing air, the fan being provided in an air blowing port which opens in a case, and a plurality of discharge electrodes for generating positive and negative ions by corona discharge, the discharge electrodes being provided in the case at positions facing the air blowing port. The ionizer also includes a plurality of discharge electrode pairs each constituted by two discharge electrodes for generating ions of different polarities. When a tip-center distance denotes a distance from the electrode tip to the center of the air blowing port, the tip-center distances of the two discharge electrodes in the discharge electrode pairs are different from each other.

8 Claims, 6 Drawing Sheets

IONIZER

TECHNICAL FIELD

The present invention relates to an ionizer for removing electric charge from (netralize) a workpiece electrified with positive or negative charge, and more specifically to a fan-type ionizer including discharge electrodes for generating positive and negative ions and a fan for producing an air flow carrying the ions.

BACKGROUND ART

In treatment processes for various workpieces such as semiconductor wafers and liquid crystal glass, ionizers are used to neutralize (destaticize) positive or negative charge on an electrostatically charged workpiece. Some ionizers utilize corona discharge while others utilize soft X-rays. The ionizers utilizing corona discharge are roughly classified into a direct-current ionizer and an alternating-current ionizer. In general, the direct-current type ionizer has needle-like positive discharge electrodes and negative discharge electrodes. When positive and negative high-voltages are applied to the discharge electrodes, corona discharge is generated at discharge parts of the electrodes to generate positive and negative ions. The positive and negative ions are blown by air onto a workpiece to neutralize positive or negative charge on the workpiece.

In some ionizers of this type, the positive discharge electrodes and the negative discharge electrodes are arranged in proximity to each other so that corona discharge can be generated by applying relatively low high-voltage. In this case, the positive ion sources and the negative ion sources are provided in proximity to each other.

Patent Document 1 (Japanese Unexamined Patent Application Publication No. 2004-253192) and Patent Document 2 (Japanese Unexamined Patent Application Publication No. 2004-253193) disclose a fan-type ionizer that uses a fan to produce an air flow. In the ionizer, the fan is provided in an air blowing port which opens in a case, and positive and negative discharge electrodes are provided at intervals of approximately 90 degrees in the circumferential direction of the air blowing port. Positive and negative ions generated by the discharge electrodes are blown onto a workpiece by an air flow from the fan.

In the ionizer disclosed in the documents, however, the positive and negative discharge electrodes are spaced apart from each other, and thus application of higher high-voltage to the discharge electrodes is required in order to generate corona discharge.

This voltage issue can be resolved by disposing positive and negative discharge electrodes 20A, 20B in proximity to each other, as shown, for example, in FIG. 10. In the fan-type ionizer, a fan 21 rotates to produce an air flow, which travels while swirling around the rotational center O of the fan 21 as a spiral flow. Therefore, if the positive and negative discharge electrodes 20A, 20B are positioned in proximity to each other, in particular at equal distances from the rotational center O of the fan 21, flows 22A, 22B of the generated positive and negative ions overlap each other while the ions are being carried by the spiral air flow, as indicated by the arrows in FIG. 10 in relation to one pair of the discharge electrodes 20A, 20B, and thus the positive and negative ions may easily recombine to be neutralized. As a result, the amount of ions that reach a workpiece may be reduced, causing a problem that a removal efficiency of electricity falls.

DISCLOSURE OF INVENTION

The object of the present invention, therefore, is to provide an ionizer including discharge electrodes for generating ions and a fan for producing an air flow provided in an air blowing port in a case with an enhanced destaticization efficiency achieved by arranging the discharge electrodes such that the flows of positive and negative ions will not overlap each other to prevent recombination of ions and thus increase the amount of ions to be fed to a workpiece.

In order to achieve the foregoing object, the present invention provides an ionizer having a fan for blowing air provided in an air blowing port opening in a case and a plurality of discharge electrodes for generating positive and negative ions by corona discharge provided in the case at positions facing the air blowing port, in which the ionizer includes a plurality of discharge electrode pairs each constituted by two discharge electrodes for generating ions of different polarities, and defining the distance from the electrode tip to the center of the air blowing port as tip-center distance, the tip-center distances of the two discharge electrodes in the discharge electrode pairs are different from each other.

In the present invention, in addition, the ionizer includes a plurality of first discharge electrode pairs each constituted by a positive discharge electrode with a large tip-center distance and a negative discharge electrode with a small tip-center distance and a plurality of second discharge electrode pairs each constituted by a positive discharge electrode with a small tip-center distance and a negative discharge electrode with a large tip-center distance, the number of the first discharge electrode pairs being the same as that of the second discharge electrode pairs, and the first discharge electrode pairs and the second discharge electrode pairs being disposed alternately around the center of the air blowing port.

In this case, the tip-center distance of the positive discharge electrode in the first discharge electrode pairs is equal to that of the negative discharge electrode in the second discharge electrode pairs, and the tip-center distance of the negative discharge electrode in the first discharge electrode pairs is equal to that of the positive discharge electrode in the second discharge electrode pairs.

In the present invention, the distance between the tips of adjacent discharge electrodes in adjacent discharge electrode pairs is preferably larger than the distance between the tips of the two discharge electrodes in the discharge electrode pairs.

In addition, the discharge electrodes are preferably covered by an insulating material except for the tip portion for electrical discharge.

In the present invention, the plurality of discharge electrode pairs may be disposed at regular intervals in the circumferential direction of the air blowing port, and the two discharge electrodes in each of the discharge electrode pairs may be disposed adjacent to and in proximity to each other in the circumferential direction of the air blowing port with the electrode tips pointing inwardly of the air blowing port.

Alternatively, the plurality of discharge electrode pairs may be disposed in a region inside the air blowing port, and the two discharge electrodes in each of the discharge electrode pairs may be disposed at different distances from each other from the center of the air blowing port with the electrode tips pointing in the air blowing direction.

In the ionizer of the present invention, the distance (tip-center distance) from the tip of a discharge electrode to the center of the air blowing port is different between the two discharge electrodes in the discharge electrode pairs, and thus positive and negative ions are generated at different positions in the radial direction of the air blowing port. Therefore, the flows of the positive and negative ions do not overlap easily even when the ions are carried spirally by a spiral air flow produced by rotation of the fan. As a result, the amount of ions to be neutralized by recombination reduces, and thus the amount of ions that reach a workpiece increases, thereby improving the destaticization efficiency.

BEST MODE FOR CARRYING OUT THE INVENTION

Figure 1:
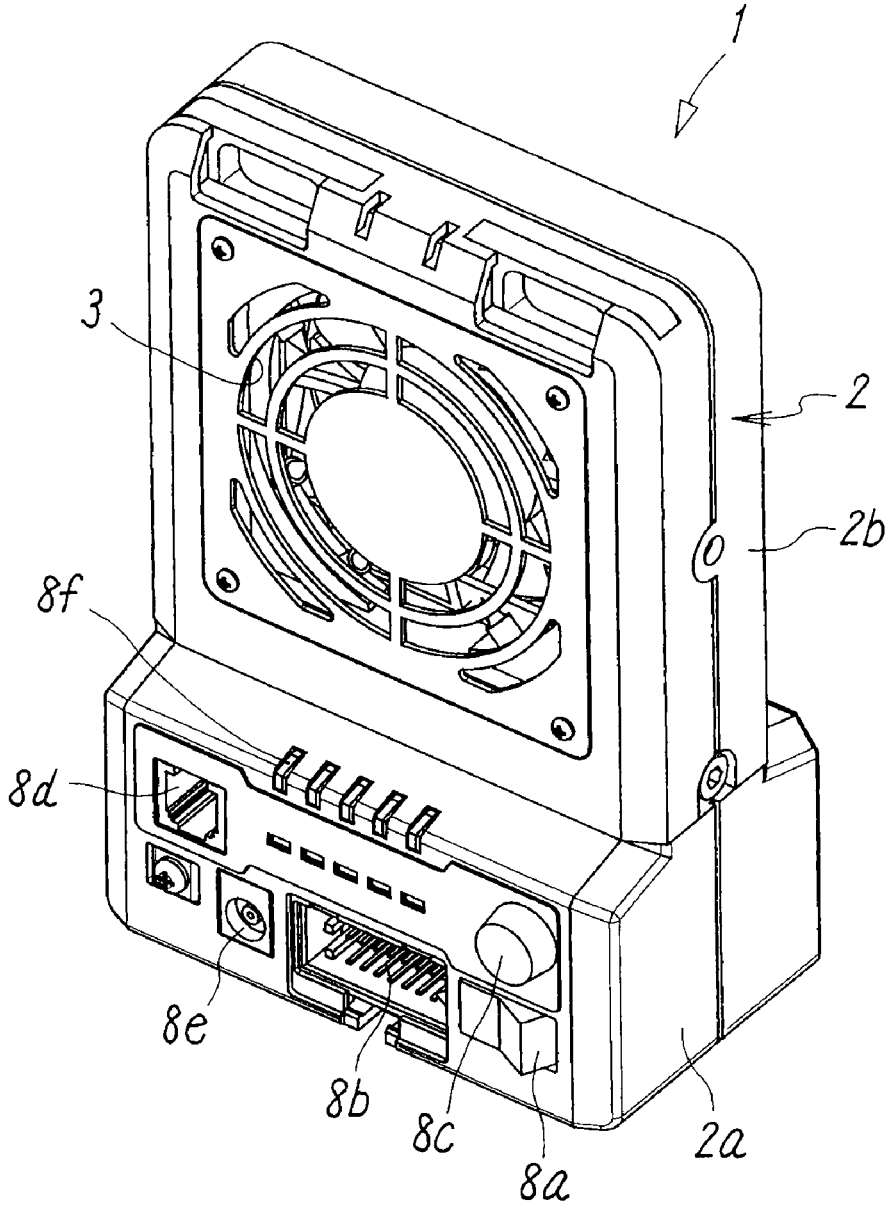
FIG. 1 is a perspective view showing a first embodiment of an ionizer in accordance with the present invention.
Figure 2:
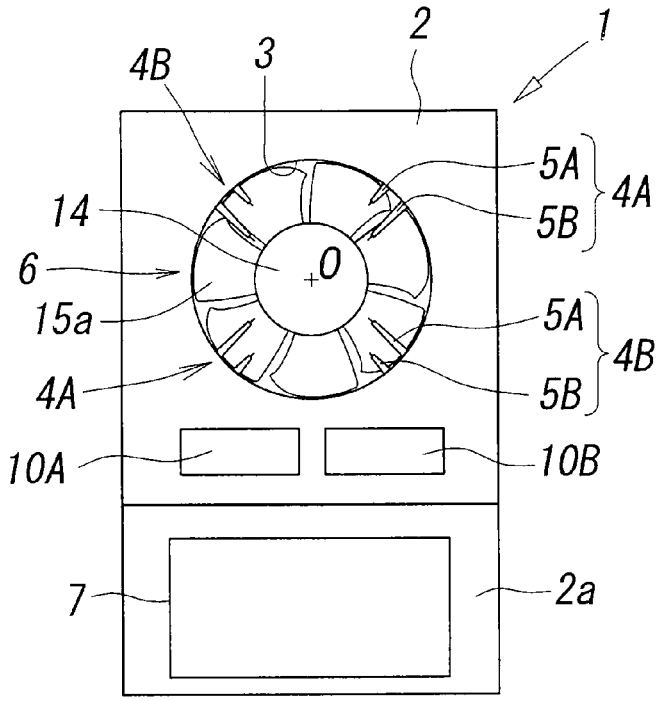
FIG. 2 is a front view showing the arrangement of discharge electrodes and a fan in the ionizer of FIG. 1.
Figure 3:
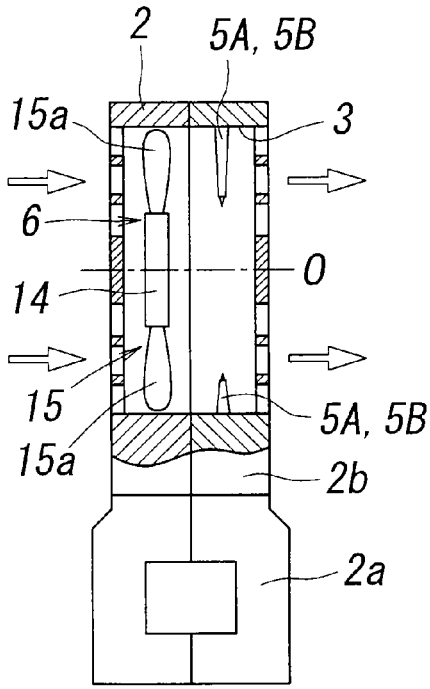
FIG. 3 is a vertical cross-sectional side view of FIG. 2.

FIGS. 1 to 3 schematically show a first embodiment of an ionizer in accordance with the present invention. An ionizer 1 has a substantially rectangular case 2 formed of a synthetic resin. The case 2 has a base part 2*a* that is wider in the front-and-back direction than an ion generation part 2*b* that extends upward from the base part 2*a*. However, the base part 2*a* and the ion generation part 2*b* may have the same widths in the front-and-back direction. In addition, the base part 2*a* and the ion generation part 2*b* may be formed integrally with each other, or may be formed separately from each other and coupled to each other in a detachable manner.

The base part 2*a* houses a control device 7 for controlling the operation of the overall ionizer. The front surface of the base part 2*a* is provided with a power switch 8*a*, a connector 8*b* for connecting a wire to an external power source or an external instrument, a rotary switch 8*c* for air volume control, a modular connector 8*d* for connection of an external sensor, a DC adapter connecting jack 8*e*, indicators 8*f* for indicating the operating state, and so forth.

In the ion generation part 2*b*, a circular air blowing port 3 is formed to penetrate the ion generation part 2*b* in the front-and-back direction. At the inner peripheral portion of the air blowing port 3, a plurality of discharge electrode pairs 4A and 4B are disposed at regular intervals around the center O of the air blowing port 3. The discharge electrode pairs 4A and 4B are each constituted by a positive discharge electrode 5A and a negative discharge electrode 5B for generating positive ions and negative ions, respectively, by corona discharge. Inside the air blowing port 3, a fan 6 is provided for producing an air flow to feed the positive and negative ions generated by the discharge electrodes 5A and 5B to an electrified workpiece. The air blowing port 3 may be noncircular.

The ion generation part 2*b* houses a positive high-voltage source 10A for applying a positive high-voltage to the positive discharge electrodes 5A and a negative high-voltage source 10B for applying a negative high-voltage to the negative discharge electrodes 5B. The high-voltage sources 10A, 10B are connected to the control device 7 and the discharge electrodes 5A, 5B, respectively. Thus, the ionizer of this embodiment is a direct-current ionizer. The ionizer of this embodiment may be any of two types of direct-current ionizers, that is, the DC type which requires continuous application of a constant high-voltage and the DC pulse type which requires application of high-voltage pulses.

The high-voltage sources 10A, 10B may be disposed inside the base part 2*a* together with the control device 7. Alternatively, the control device 7 and the high-voltage sources 10A, 10B may be disposed inside the ion generation part 2*b*.

Figure 4:
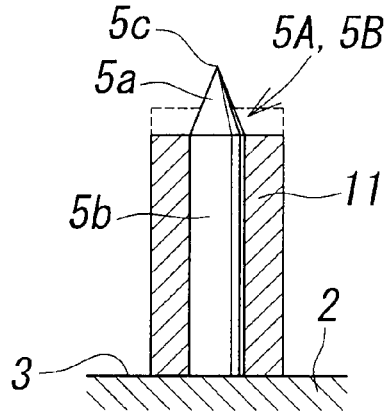
FIG. 4 is a cross-sectional view showing the configuration of a discharge electrode.

As shown in FIG. 4, the positive and negative discharge electrodes 5A and 5B have a columnar main portion 5*b* and a gradually tapered tip portion 5*a*.

The main portion 5*b* is covered by an insulating material 11 such as a synthetic resin so that only the tip portion 5*a* is exposed to the outside. Corona discharge is produced at the exposed tip portion 5*a* to generate ions. Thus, the tip portion 5*a* serves as a discharge part. Hence, the tip portion 5*a* may also be referred to as "discharge part 5*a*" in the following description.

The tip of the discharge part 5*a* of the discharge electrodes 5A and 5B may be pointed like a cone or slightly rounded.

As indicated by the chain line in FIG. 4, the discharge electrodes 5A and 5B may be covered by the insulating material 11 to an intermediate position of the gradually tapered portion.

Figure 5:
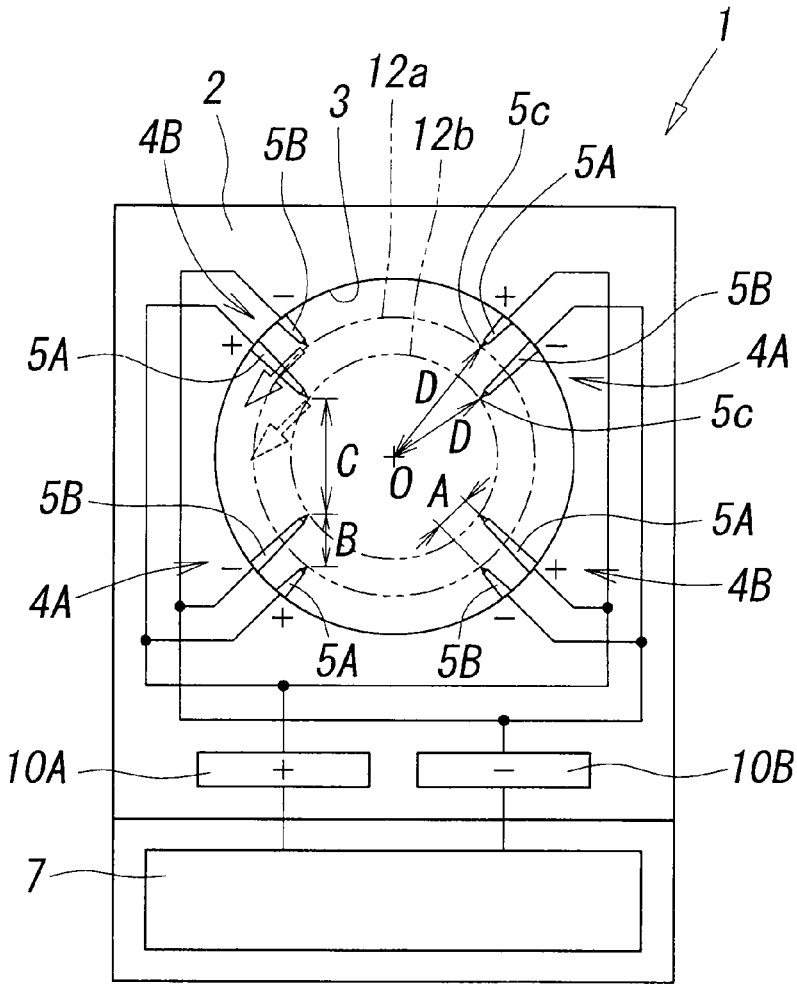
FIG. 5 is a front view showing an exemplary arrangement of the discharge electrodes.

The positive and negative discharge electrodes 5A and 5B in the discharge electrode pairs 4A and 4B are disposed along the inner peripheral portion of the air blowing port 3 in the case 2, adjacent to and in proximity to each other in the circumferential direction of the air blowing port 3, to project inwardly of the air blowing port 3 with the electrode tip 5*c* pointing toward the center O of the air blowing port 3 or the vicinity of the center O. In the example shown, the discharge electrodes 5A and 5B are disposed in parallel to each other. However, in the case where the electrode tips 5*c* point toward the center O of the air blowing port 3, the discharge electrodes 5A and 5B are not parallel to each other with the gap between the discharge electrodes 5A and 5B becoming smaller from the base side toward the tip side. As shown in FIG. 5, the positive discharge electrodes 5A are connected to the positive high-voltage source 10A of the control device 7, and the negative discharge electrodes 5B are connected to the negative high-voltage source 10B of the control device 7.

The positive discharge electrodes 5A and the negative discharge electrodes 5B in the discharge electrode pairs 4A and 4B are formed to have different lengths from each other. That is, the distance (tip-center distance) D from the electrode tip 5*c* to the center O of the air blowing port 3 is different between the positive negative discharge electrodes 5A and the negative discharge electrodes 5B. In the example of FIG. 5, the first discharge electrode pairs 4A are each composed of the positive discharge electrode 5A with a small length and thus a large tip-center distance D and the negative discharge electrode 5B with a large length and thus a small tip-center distance D. Meanwhile, the second discharge electrode pairs 4B are each composed of the positive discharge electrode 5A with a large length and thus a small tip-center distance D and the negative discharge electrode 5B with a small length and thus a large tip-center distance D.

Two sets of the first discharge electrode pairs 4A and two sets of the second discharge electrode pair 4B are provided. The total of four sets of the discharge electrode pairs 4A and 4B are disposed at regular intervals of approximately 90 degrees around the center O of the air blowing port 3 such that the first discharge electrode pairs 4A and the second discharge electrode pairs 4B are respectively positioned opposite each other. In other words, the first discharge electrode pairs 4A and the second discharge electrode pairs 4B are disposed alternately in the circumferential direction of the air blowing port 3. A positive discharge electrode 5A and a negative discharge electrode 5B with opposite polarities to each other are disposed in positions adjacent to a first discharge electrode pair 4A and second discharge electrode pair 4B, respectively.

Thus, the tips 5*c* of the positive and negative discharge electrodes 5A and 5B with a large tip-center distance D are positioned on the circumference of a large circle 12*a*, of two virtual concentric circles of different sizes centered on the center O of the air blowing port 3, and the tips 5*c* of the positive and negative discharge electrodes 5A and 5B with a small tip-center distance D are positioned on the circumference of a small circle 12*b*.

Defining the distance between the positive and negative discharge electrodes 5A and 5B in the discharge electrode pairs 4A and 4B as A, the distance between the tips 5*c* of the discharge electrodes 5A and 5B as B, and the distance between the tips 5*c* of the adjacent discharge electrodes 5A and 5B in two adjacent sets of the discharge electrode pairs 4A and 4B as C, the relationship A<B<C is satisfied.

The fan 6 is constituted by an electric motor 14 positioned centrally and a bladed wheel 15 attached to the output shaft of the motor 14. The fan 6 is disposed inside and concentrically with the air blowing port 3 with the motor 14 electrically connected to the control device 7. A plurality of blades 15A are attached to the bladed wheel 15. The blades 15*a* produce a spiral air flow which travels while swirling around the center O of the air blowing port 3.

At the exit end of the air blowing port 3, an ozone filter for removing ozone may be provided inside or outside the air blowing port 3 so that ozone generated by the discharge electrodes and so forth will be removed by the ozone filter.

In the ionizer 1 configured as described above, when the positive and negative high-voltage sources 10A and 10B of the control device 7 respectively apply positive and negative high-voltages, simultaneously or alternately, to the positive and negative discharge electrodes 5A and 5B in each of the discharge electrode pairs 4A and 4B, corona discharge is generated at the discharge parts 5*a* of the discharge electrodes 5A and 5B to generate positive and negative ions. Since the distance B between the tips of the discharge electrodes 5A and 5B is small, the positive and negative high-voltages applied to the positive and negative discharge electrodes 5A and 5B at this time can be set lower than those in the case where the ionizer disclosed in Patent Document 1 or 2 is used, in which the distance between the tips of the positive and negative discharge electrodes is large. Thus, smaller high-voltage units with a lower output voltage can be used as the positive and negative high-voltage sources 10A and 10B, thereby reducing the size of the ionizer.

Figure 10:
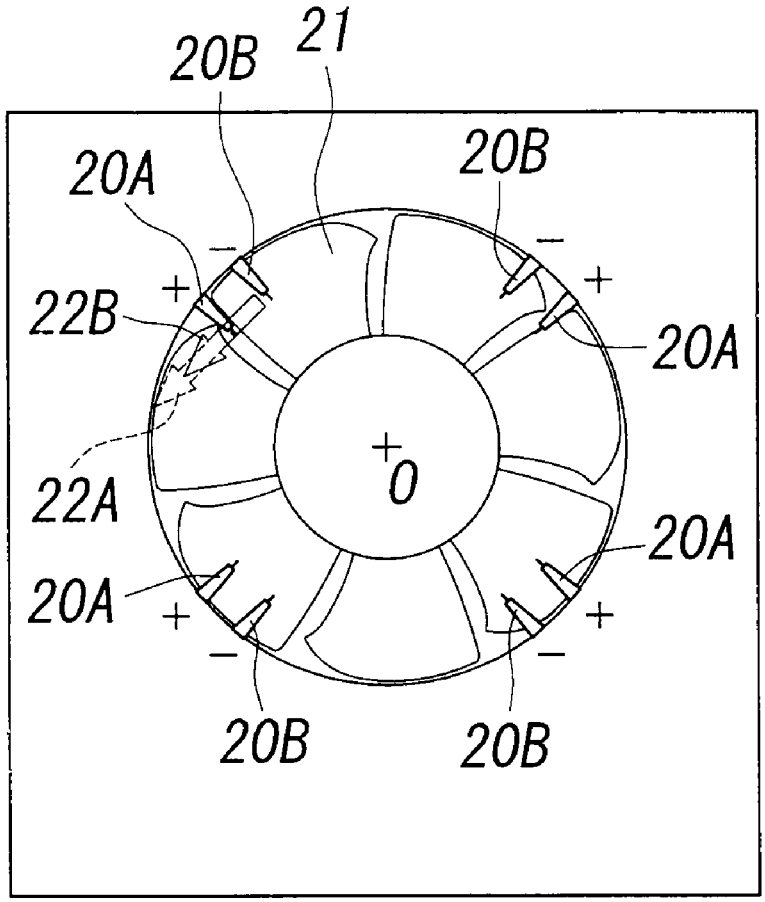
FIG. 10 is a front view showing an exemplary arrangement of discharge electrodes in an ionizer to be improved by the present invention.

The positive and negative ions generated by the discharge electrodes 5A and 5B are fed to a workpiece by the air flow from the fan 6 to destaticize the workpiece which has been electrified. At this time, the air flow travels while diffusing gradually as a spiral flow which swirls around the rotational center of the fan (i, that is, the center O of the air blowing port 3, and thus the positive and negative ions are also carried in the direction of the spiral air flow. However, since the tip-center distance D is different between the positive discharge electrodes 5A and the negative discharge electrodes 5B, positive and negative ions are generated at different locations in the radial direction of the air blowing port 3, as indicated by the arrows in FIG. 5 in relation to one of the discharge electrode pairs 4B. Therefore, the positive and negative ions do not easily recombine to neutralize each other. Even if some of the ions should mix and recombine with each other, the amount of ions to be recombined is markedly small compared to the case where the tip-center distance is equal between the positive and negative discharge electrodes 20A and 20B as shown in FIG. 10. Thus, the amount of ions neutralized by recombination is reduced, and hence the amount of ions that reach a workpiece is increased, which destaticizes the workpiece which has been electrified efficiently in a short period.

Now, with reference to FIG. 5, a first discharge electrode pair 4A and a second discharge electrode pair 4B positioned adjacent to each other are considered. The tip 5*c* of the positive discharge electrode 5A in the first discharge electrode pair 4A and the tip 5*c* of the negative discharge electrode 5B in the second discharge electrode pair 4B, and the tip 5*c* of the negative discharge electrode 5B in the first discharge electrode pair 4A and the tip 5*c* of the positive discharge electrode 5A in the second discharge electrode pair 4B, are respectively located at the same distance from the air blowing port 3 in the radial direction, that is, on the same circle that is concentric with the air blowing port 3. However, since the distance C between the discharge electrodes is large, the ions do not easily contact with each other while being carried by the air flow.

Moreover, the first discharge electrode pairs 4A, each constituted by a positive discharge electrode 5A with a large tip-center distance D and a negative discharge electrode 5B with a small tip-center distance D, and the second discharge electrode pair 4B, each constituted by a positive discharge electrode 5A with a small tip-center distance D and a negative discharge electrode 5B with a large tip-center distance D, are disposed alternately, with the discharge parts 5*a* of the positive discharge electrodes 5A and the negative discharge electrodes 5B located at different positions in the radial direction of the air blowing port 3. Therefore, the ion distribution is averaged in the radial direction of the air blowing port 3, which improves the ion balance.

Figure 6:
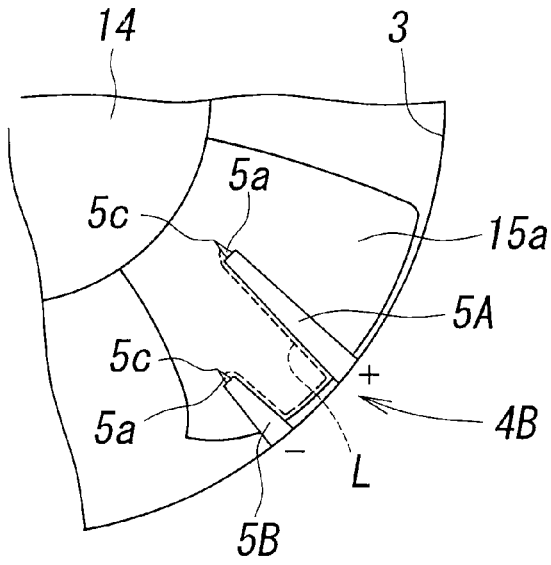
FIG. 6 is an enlarged view showing a pair of discharge electrodes.

Furthermore the discharge electrodes 5A and 5B are covered by an electrical insulator except for the discharge part 5*a*. Therefore, as shown in FIG. 6 in relation to one discharge electrode pair 4B, the creepage distance L (indicated by the dotted line) between the respective discharge parts 5*a* of the discharge electrodes 5A and 5B via the surface of the insulating material 11 and the inner peripheral surface of the air blowing port 3 can be made longer than that in the case where no such electrical insulator is provided, even if the positive and negative discharge electrodes 5A and 5B are arranged in proximity to each other. Impurities may be deposited on the discharge electrodes through long hours of use or use in adverse environments to cause electrical breakdown. This configuration also provides an advantage that the period until such electrical breakdown is extended.

Figure 7:
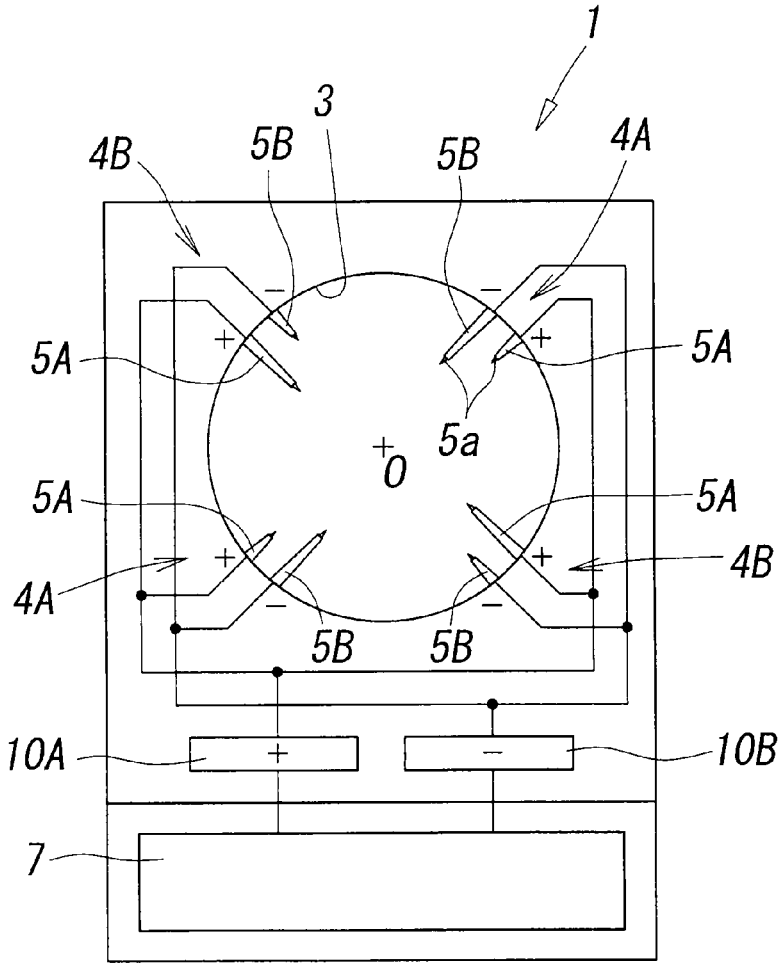
FIG. 7 is a front view showing another exemplary arrangement of the discharge electrodes.

FIG. 7 schematically shows a second embodiment of an ionizer in accordance with the present invention. The ionizer 1 of the second embodiment is different from the ionizer 1 of the first embodiment shown in FIG. 5 in the arrangement of the discharge electrodes 5A and 5B. That is, in the ionizer 1 of the second embodiment, the positive discharge electrodes 5A or the negative discharge electrodes 5B with the same polarity are disposed in adjacent positions of adjacent first discharge electrode pair 4A and second discharge electrode pair 4B.

Other configurations and functions are substantially the same as those of the ionizer of the first embodiment. Hence, the same components as those of the first embodiment are denoted by the same reference numerals as those in the first embodiment, and their descriptions are omitted.

In the above embodiments, the discharge electrodes 5A and 5B are attached to the inner periphery of the air blowing port 3. However, the discharge electrodes may be attached to a portion of the case 2 outside the air blowing port 3.

Figure 8:
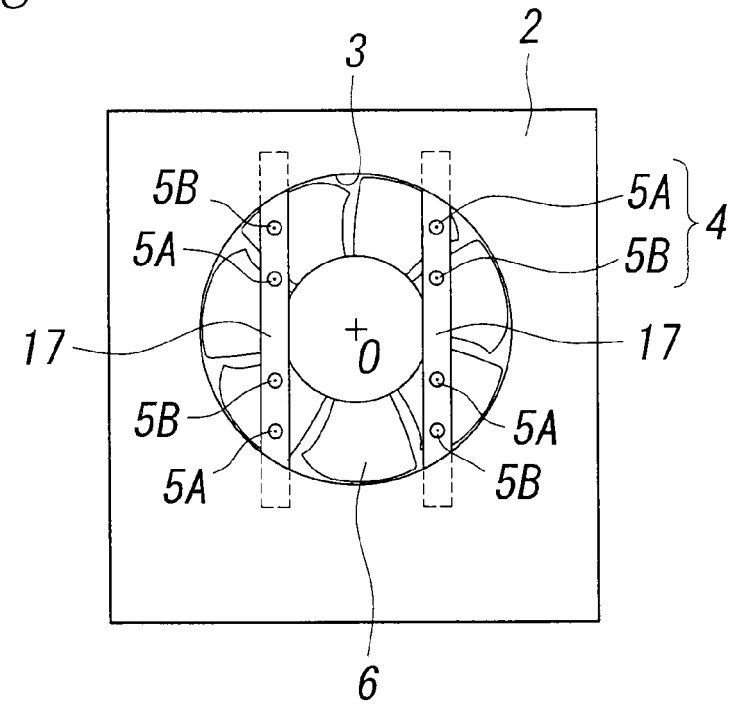
FIG. 8 is a front view showing still another exemplary arrangement of the discharge electrodes.
Figure 9:
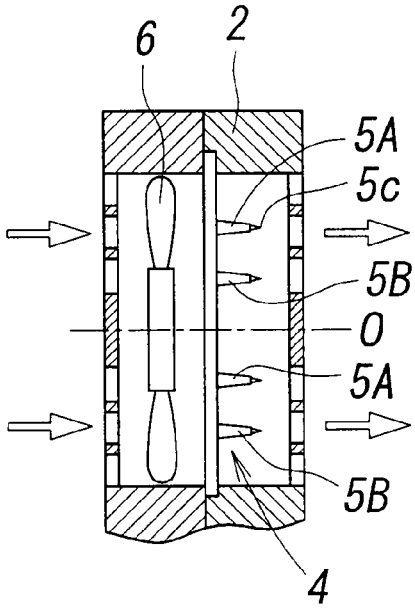
FIG. 9 is a cross-sectional view of FIG. 8.

The discharge electrodes 5A and 5B may not necessarily be disposed around the air blowing port 3 along the inner periphery of the air blowing port 3 as in the above embodiments, and may be provided in a region inside the air blowing port 3 as shown for example in FIGS. 8 and 9. Specifically, two bar-like support members 17 are provided at positions across the center O of the air blowing port 3 to extend across the air blowing port 3 in parallel to each other. Four sets of discharge electrode pairs 4 are attached to positions on the support members 17 opposite to each other, and the positive and negative discharge electrodes 5A and 5B are attached in parallel to each other with the respective electrode tips 5*c* pointing in the air blowing direction. In this case, although all the discharge electrodes 5A, 5B are of the same length, the distances from the center O of the air blowing port 3 to the two discharge electrodes 5A and 5B in each of the discharge electrode pairs 4 are different from each other. Therefore, the tip-center distances of the discharge electrodes 5A and 5B in each of the discharge electrode pairs 4 are also different from each other.

Although the ionizers in the above embodiments are direct-current ionizers, the present invention may also be applied to alternating-current ionizers. In this case, an alternating high-voltage may be applied to the discharge electrodes 5A and 5B in each of the discharge electrode pairs 4A and 4B in the ionizer of FIG. 5 or 7, for example, such that the polarities of the discharge electrodes 5A and 5B are opposite to each other and the polarities of adjacent discharge electrodes of adjacent discharge electrode pairs 4A and 4B are different from or the same as each other. This also applies to the ionizer of FIG. 8.

The invention claimed is:

1. An ionizer comprising:

a fan for blowing air, the fan provided in an air blowing port which opens in a case; and a plurality of discharge electrodes for generating positive and negative ions by corona discharge, the discharge electrodes provided in the case at positions facing the air blowing port, wherein the ionizer has a plurality of discharge electrode pairs each constituted by two discharge electrodes for generating ions of different polarities, and when a tip-center distance denotes a distance from an electrode tip to a center of the air blowing port, the tip-center distances of the two discharge electrodes in the discharge electrode pairs are different from each other, wherein the ionizer includes a plurality of first discharge electrode pairs each constituted by a positive discharge electrode with a large tip-center distance and a negative discharge electrode with a small tip-center distance, and a plurality of second discharge electrode pairs each constituted by a positive discharge electrode with a small tip-center distance and a negative discharge electrode with a large tip-center distance, the number of the first discharge electrode pairs being the same as the number of the second discharge electrode pairs, and the first discharge electrode pairs and the second discharge electrode pairs are disposed alternately around the center of the air blowing port, and wherein the tip-center distance of the positive discharge electrode in the first discharge electrode pairs is equal to the tip-center distance of the negative discharge electrode in the second discharge electrode pairs, and the tip-center distance of the negative discharge electrode in the first discharge electrode pairs is equal to the tip-center distance of the positive discharge electrode in the second discharge electrode pairs.

2. The ionizer according to claim 1, wherein the distance between tips of adjacent discharge electrodes in adjacent discharge electrode pairs is larger than the distance between tips of the two discharge electrodes in the discharge electrode pairs.

3. The ionizer according to claim 1, wherein the discharge electrodes are covered with an insulating material except for a tip portion for performing electrical discharge.

4. The ionizer according to claim 1, wherein the plurality of discharge electrode pairs are disposed at regular intervals in the circumferential direction of the air blowing port, and the two discharge electrodes in each of the discharge electrode pairs are disposed adjacent to and in proximity to each other in the circumferential direction of the air blowing port with electrode tips pointing inwardly of the air blowing port.

5. An ionizer comprising a fan for blowing air, the fan provided in an air blowing port which opens in a case, and a plurality of discharge electrodes for generating positive and negative ions by corona discharge, the discharge electrodes provided in the case at positions facing the air blowing port, wherein the ionizer has a plurality of discharge electrode pairs each constituted by two discharge electrodes for generating ions of different polarities, and when a tip-center distance denotes a distance from an electrode tip to a center of the air blowing port, the tip-center distances of the two discharge electrodes in the discharge electrode pairs are different from each other, the tips of the discharge electrodes with a large tip-center distance are positioned on the circumference of a large circle, of two virtual concentric circles of different sizes centered on a center line of the air blowing port, and the tips of the discharge electrodes with a small tip-center distance are positioned on the circumference of a small circle, and the discharge electrodes for generating ions of different polarities are disposed alternately along the circumference of each circle.

6. The ionizer according to claim 5, wherein the tips of the discharge electrode in all discharge electrode pairs are provided in one plane surface which is perpendicular to the center line of the air blowing port.

7. The ionizer according to claim 5, the discharge electrodes are disposed in a position where the electrode tips face toward the inside of the air blowing port.

8. The ionizer according to claim 5, the discharge electrodes are disposed so that an electrode axis is directed parallel to the center line of the air blowing port.

* * * * *